United States Patent [19]

Gallegos

[11] 4,345,732

[45] Aug. 24, 1982

[54] SUPPORTING BRACKET FOR MUSICAL INSTRUMENTS

[76] Inventor: Manuel Gallegos, 5094 Milwaukee St., Denver, Colo. 80216

[21] Appl. No.: 178,004

[22] Filed: Aug. 14, 1980

[51] Int. Cl.[3] ..... G10G 5/00

[52] U.S. Cl. ..... 248/441 B; 248/201

[58] Field of Search ..... 248/122, 201, 441 B, 248/441 C, 441 R; 84/327

[56] References Cited

U.S. PATENT DOCUMENTS

| | | | |
|---|---|---|---|
| 3,664,224 | 5/1972 | Campagna | 84/327 X |
| 3,765,633 | 10/1973 | Caudill | 248/229 |
| 3,958,786 | 5/1976 | Mann | 84/237 X |
| 4,084,778 | 4/1978 | Dominguez | 248/300 X |
| 4,176,580 | 12/1979 | Gallegos | 248/224.1 |

*Primary Examiner*—William H. Schultz

*Attorney, Agent, or Firm*—W. Britton Moore

[57] ABSTRACT

A supporting bracket for guitars and other stringed instruments embodying at least a pair of generally L-shaped metal hanger rods encased in plastic with their ends covered by caps. The rods are attachable to the top and bottom walls of an amplifier by flat metal mounting plates having channels therein snugly and sleevably accommodating the rod shanks so that the latter are projectable at right angles to a side wall of the amplifier with the bent ends extending generally parallel thereto in opposing alignable relation and are frictionally slidably adjustable relative to the channeled mounting plates to enable the bent end of the lowermost rod or rods to receive and support the lower end of the guitar, and the corresponding bent end of the uppermost rod embracing the finger board portion thereof to securely erectly support the instrument on the amplifier accessible to a musician.

8 Claims, 5 Drawing Figures

SUPPORTING BRACKET FOR MUSICAL INSTRUMENTS

BRIEF SUMMARY OF THE INVENTION

This invention relates to supporting brackets for retaining guitars and other stringed instruments in erect positions relative to an amplifier, wherein at least a pair of generally L-shaped tubular metal hanger rods, encased in plastic with their ends covered by caps, are attachable to the top and bottom walls of the amplifier by flat mounting plates. The latter are formed with channels for snugly and sleevably accommodating the rod shanks so that the latter are projectable at right angles to a side wall of the amplifier whereby the bent ends are spaced therefrom and extend generally parallel thereto in opposing alignable relation and are frictionally slidably adjustable relative to the channeled mounting plates. The bent end or ends of the lowermost rod or rods receive and support the lower end of the guitar, and the corresponding bent end of the uppermost rod embraces the finger board portion thereof to securely erectly support the instrument on the amplifier conveniently and accessibly to a musician.

CROSS REFERENCE TO PRIOR ART

While various supporting stands and brackets, such as represented by Applicant's own U.S. pat. Nos. 4,176,580 and other U.S. patents to Rowling 1,787,734, Mann 3,958,786, and Cole 4,078,753, have heretofore been proposed, none thereof have enabled stringed instruments to be erectably, securely, and adjustably supported generally parallel to a flat wall of an amplifier so as to be conveniently positioned to a musician.

SUMMARY OF THE INVENTION

The principal object of the present invention is to provide a supporting bracket including a generally L-shaped tubular metal rod cylindrically encased in plastic with the ends covered with caps, and attachable by screws and the like to the top and bottom walls of a conventional rectangular amplifier by a flat metal mounting plate formed with a centrally arranged elongated generally U-shaped channel for snugly and sleevably accommodating and clamping the rod shank to the amplifier wall for frictional sliding adjustment relative thereto.

A further object is to provide a generally L-shaped tubular metal rod for a supporting bracket wherein one end thereof is bent at right angles with its terminus being laterally and inwardly offset and with the rod being cylindrically encased in clear plastic so as to be frictionally and adjustably sleeved within the channel of a flat metal plate for clamping attachment to the top and bottom walls of an amplifier.

Still another object is the provision of a flat generally rectangular mounting plate centrally formed with a generally U-shaped channel extending lengthwise thereof and of a depth to snugly accommodate the shank of a plastic cylindrically encased L-shaped tubular metal rod, with the plate being apertured at its corners for flat suitable attachment to the top and bottom walls of an amplifier whereby the rod is frictionally clamped between the channel and wall end is longitudinally frictionally adjustable relative thereto to suitably space the bent end of the rod relative to the side wall of the amplifier in position for supporting interengagement with a guitar.

A still further object is to provide a generally L-shaped plastic cylindrically encased metal rod combined with a channeled flat metal plate for clampable positioning on the upper and lower walls of a generally rectangular amplifier whereby the projecting bent ends of the uppermost plastic encased rods depend downwardlyand those of the lowermost plastic encased rods project upwardly in generally aligned relation.

These and other objects and advantages will be apparent as the specification is considered with the accompanying drawings, wherein.

DETAILED DESCRIPTION

Figure 1:
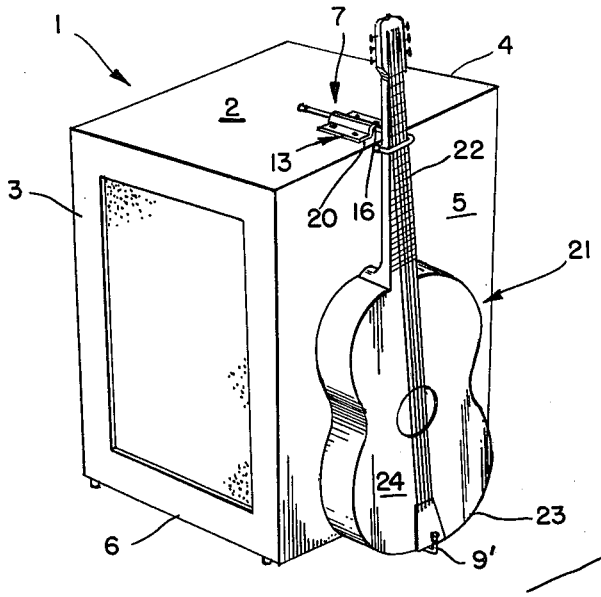
FIG. 1 is a perspective view of a generally rectangular amplifier with a guitar erectably supported on a flat side wall thereof by an aligned pair of supporting brackets arranged on the upper and lower walls.

Referring more particularly to the drawings, wherein similar reference characters designate like parts throughout the several views, numeral 1 refers to a generally rectangular, boxlike amplifier, of the type usually employed by musicians for amplifying stringed instruments and the like, including flat top 2, front wall 3, rear wall 4, side wall 5, and bottom wall 6. While the hereinafter to be described supporting bracket 7 is shown as being mounted on the top wall 2 and bottom wall 6 of an amplifier 1, it will be apparent that it may be mounted on any flat wall surface.

Figure 2:
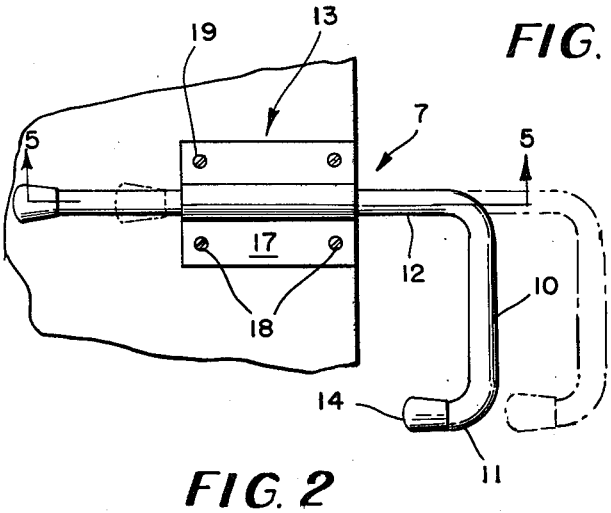
FIG. 2 is a top plan view of the uppermost bracket showing the plastic cylindrically encased generally L-shaped rod slidably adjustably clamped by its channeled plate to the top wall of an amplifier.
Figure 3:
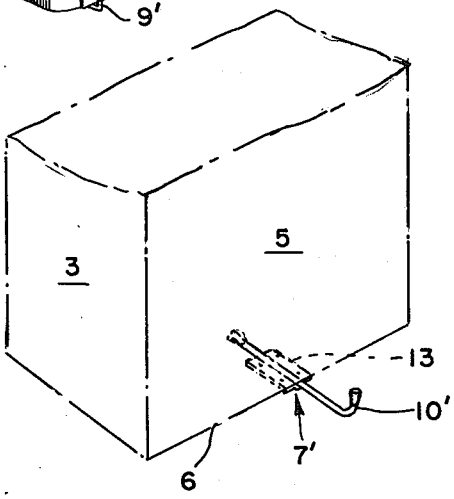
FIG. 3 is a perspective view of the lowermost portion of an amplifier, with a single supporting bracket clampingly positioned on the underside of the bottom amplifier wall.
Figure 4:
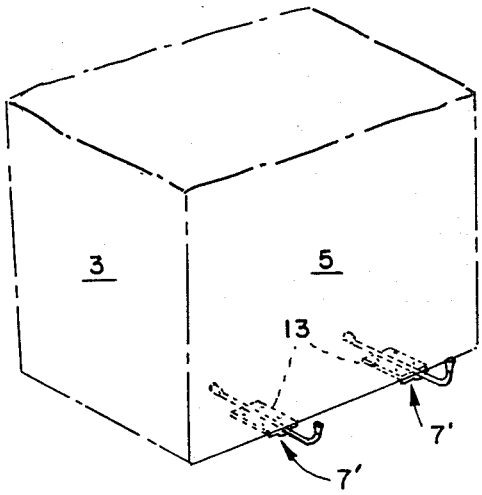
FIG. 4 is a perspective view, similar to FIG. 3, but with a pair of brackets spacedly arranged on the bottom wall.
Figure 5:
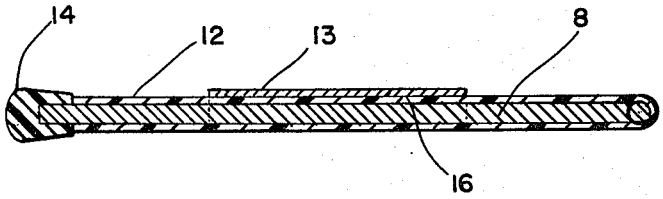
FIG. 5 is a section on the line 5—5 of FIG. 2.

As best illustrated in FIGS. 1, 3 and 4, there are at least two supporting brackets 7 arranged on the top and bottom walls 2 and 6, with the brackets being oppositely disposed in alignment. However, where the stringed instrument is larger and bulkier than usual, it may be desirable to provide two spaced brackets 7 on the bottom wall 6, in which event the uppermost bracket will preferably be mounted on the top wall intermediate the lower brackets. With particular reference to FIGS. 2 and 5, the uppermost supporting bracket 7 includes a generally L-shaped metal rod 8, of tubular or solid construction, and having a straight elongated shank portion 9, with one end bent laterally at right angles, at a point approximately two thirds of its length, as at 10, and its terminus bent or offset rearwardly, as at 11. The lowermost supporting bracket $7^1$ differs somewhat in contour from the uppermost bracket 7 in that the elongated shank $9^1$ thereof has a shorter right angular bend $10^1$ on one end thereof, and its terminus is not required to be bent or offset rearwardly, as previously described.

In both upper and lower brackets 7—$7^1$, the rods 8 are cylindrically encased or coated with a suitable plastic jacket or casing 12, which may be translucent and is sufficiently soft or pliable so as to snugly encompass the rod and adapt the same to be snugly and frictionally sleeved within the about to be described metal mounting plate 13. This plastic jacket 12 fully encases rod 8, and the ends thereof are covered by suitable caps 14 of rubber or the like, which function to retain the bracket rod 8 within its clamping plate 13 and prevent marring of the musical instrument being supported thereby, as presently will be apparent.

Each of the brackets 7—7[1] is attached to the flat top and bottom walls 2–6 of the amplifier by a rectangular generally flat metal mounting plate 13, shorter in length than the straight shank portion 9. The plate is formed with a concave generally U-shaped channel 16 extending lengthwise and centrally thereof and projecting beyond the plane of an upper face 17 of the plate. Apertures 18 are provided in each of the corners to receive attaching screws or the like 19 for fastening the plate to an amplifier wall. With plate 15 inverted and its lower face 20 uppermost, the straight shank portion 9 of a rod may be positioned within channel 16. As the channel is slightly larger in diameter than the outside diameter of the plastic covered shank 9, the latter will snugly and frictionally interfit therein, with its annulus being on a plane with lower plate face 20. As the plate is spaced from the ends of the shank, the latter is longitudinally adjustable within the channel. However, the plastic covering 12 of the shank frictionally engages the metal channel and offers resistance to this movement, which tends to retain the bracket in its adjusted positions, as presently will be apparent.

When a stringed instrument, such as a guitar 21, is to be supported in an inactive accessible upright position, the reduced relatively narrow finger board portion 22 thereof will be uppermost and the enlarged body base portion 23 lowermost. Thus, a mounting plate 13 with a rod shank 9 arranged in the channel 16 thereof will be flatly disposed on the top wall 2 of the amplifier in the FIG. 2 position, with the upper face 17 of the plate and the channel 16 thereof projecting upwardly. The plate is thereby positioned at generally right angles to a side amplifier wall 5 and is anchored thereto by screws 19, in which position, the shank 9 will project forwardly of wall 5, and the bent outer end 10 will extend horizontally.

Either one mounting plate 13, as in FIGS. 1 and 3, or two spaced mounting plates 13, with shanks 9[1] arranged in the channels 16 thereof, as in FIG. 4, may be oppositely arranged on and similarly anchored to the bottom wall 6 of the amplifier, so that the bent ends 11 of the shanks 9[1] will project upwardly. The shanks 9—9[1] will be pulled outwardly within the channels 16 to the dotted line position of FIG. 2 to enable base portion 23 of the guitar to be arranged on and supported by the lowermost rod or rods 9[1], with the bent ends 11 thereof engaging the front face 24 of the guitar, and the bent ends 11 of the upper bracket rod 9 engaging with the finger board portion 22. Accordingly, when both the upper and lower rods are pushed inwardly of the clamping plate chanels, to the approximate full line position of FIG. 2, the guitar will be securely clamped against the side amplifier wall 5, in the upright position of FIG. 1. As previously described, the frictional engagement between the plastic jacketed rod shanks and the metal channels creates frictional resistance therebetween and serves to retain the rods in their adjusted positions without permitting slippage therebetween. When removal of the instrument is required by the musician, it is only necessary to exert an outward pull on the upper and lower rods so that the instrument may be readily disengaged therefrom, in an obvious manner.

While preferred embodiments of supporting brackets have been shown and described, it is to be understood that various changes and improvements may be made therein, without departing from the scope and spirit of the appended claims.

What I claim is:

1. A supporting bracket arrangement for mounting a guitar and other stringed musical instruments having an enlarged body case portion and a relatively narrow projecting finger board portion in an upright position relative to a side wall of a generally rectangular amplifier comprising elongated rods having laterally bent outer ends, said rods being encased in plastic jackets, and generally flat rectangular metal clamping plates associated with said rods and being formed with generally U-shaped channels extending lengthwise thereof of a diameter to snugly and frictionally accommodate said rods therein, said plates having means for flat and opposing attachment thereof to the upper and lower walls of said amplifier, said rods and plates being arranged in at least two opposing units, and said rods being frictionally slidable outwardly in said channels whereby the base portion of said guitar may be supported by a lowermost rod with the finger board portion thereof being hookingly engaged by said uppermost rod and slidable inwardly in said channels whereby said guitar is securely and erectly supported on said amplifier.

2. A supporting bracket arrangement according to claim 1, wherein said rods are metal and said plastic jackets encase said rods.

3. A supporting bracket arrangement according to claim 2, wherein said generally rectangular clamping plates are secured to the upper and lower walls of said amplifier at generally right angles to a side wall thereof whereby said rods are frictionally sleevable in said channels and are projectable relative to said side wall.

4. A supporting bracket arrangement according to claim 3, wherein said metal rods are cylindrically encased in generally soft and pliable plastic whereby said plastic will frictionally engage said metal channels for sliding relative movement with resistance relative thereto.

5. A supporting bracket arrangement according to claim 4, wherein one of said rods and clamping plates is attached to the upper wall of said amplifier, and another rod and clamping plate is attached to said lower wall generally opposite to and in vertical alignment with said uppermost rod and clamping plate.

6. A supporting bracket arrangement according to claim 4, wherein one of said rods and clamping plates is attached to the upper wall of said amplifier, and two rods and clamping plates are spacedly attached to said lower wall generally opposite to and vertically offset relative to said uppermost rod and clamping plate.

7. A supporting bracket arrangement according to claim 4, wherein said rods are generally L-shaped with elongated shank portions terminating in laterally bent forward ends.

8. A supporting bracket arrangement according to claim 7, wherein the laterally bent forward end of said uppermost rod has a rearwardly offset end portion whereby said finger board portion of said guitar is hookingly engaged thereby, and said base portion rests on and is supported upon said lowermost rods and clamped by the laterally bent forward ends thereof.

* * * * *